US008607569B2

(12) United States Patent
Helmick et al.

(10) Patent No.: US 8,607,569 B2
(45) **Date of Patent: *Dec. 17, 2013**

(54) METHODS AND SYSTEMS TO THERMALLY PROTECT FUEL NOZZLES IN COMBUSTION SYSTEMS

(75) Inventors: David Andrew Helmick, Fountain Inn, SC (US); Thomas Edward Johnson, Greer, SC (US); William David York, Greer, SC (US); Benjamin Paul Lacy, Greer, SC (US)

(73) Assignee: General Electric Company, Schenectady, NY (US)

( * ) Notice: Subject to any disclaimer, the term of this patent is extended or adjusted under 35 U.S.C. 154(b) by 1203 days.

This patent is subject to a terminal disclaimer.

(21) Appl. No.: 12/495,918

(22) Filed: Jul. 1, 2009

(65) Prior Publication Data

US 2011/0000214 A1 Jan. 6, 2011

(51) Int. Cl.
*F02C 1/00* (2006.01)
*F02G 3/00* (2006.01)
*B05B 15/00* (2006.01)

(52) U.S. Cl.
USPC ..... 60/737; 60/742

(58) Field of Classification Search
USPC ..... 60/740–748, 737
See application file for complete search history.

(56) References Cited

U.S. PATENT DOCUMENTS

| | | | | |
|---|---|---|---|---|
| 3,703,259 | A * | 11/1972 | Sturgess et al. | 239/400 |
| 5,220,786 | A * | 6/1993 | Campbell | 60/800 |
| 5,671,597 | A * | 9/1997 | Butler et al. | 60/796 |
| 6,047,539 | A * | 4/2000 | Farmer | 60/775 |
| 6,286,302 | B1 | 9/2001 | Farmer et al. | |
| 6,438,961 | B2 | 8/2002 | Tuthill et al. | |
| 6,655,146 | B2 | 12/2003 | Kutter et al. | |
| 6,821,641 | B2 | 11/2004 | Bruce et al. | |
| 6,926,496 | B2 | 8/2005 | Ackermann et al. | |
| 7,007,477 | B2 * | 3/2006 | Widener | 60/737 |
| 7,080,515 | B2 * | 7/2006 | Wasif et al. | 60/737 |
| 7,368,164 | B2 | 5/2008 | Stowell et al. | |
| 2008/0104961 | A1 | 5/2008 | Bunker | |
| 2008/0276618 | A1 | 11/2008 | Poyyapakkam | |
| 2009/0050710 | A1 * | 2/2009 | Myers et al. | 239/132.5 |

* cited by examiner

*Primary Examiner* — Andrew Nguyen
(74) *Attorney, Agent, or Firm* — Armstrong Teasdale LLP

(57) ABSTRACT

A method of assembling a gas turbine engine is provided. The method includes coupling a combustor in flow communication with a compressor such that the combustor receives at least some of the air discharged by the compressor. A fuel nozzle assembly is coupled to the combustor and includes at least one fuel nozzle that includes a plurality of interior surfaces, wherein a thermal barrier coating is applied across at least one of the plurality of interior surfaces to facilitate shielding the interior surfaces from combustion gases.

17 Claims, 4 Drawing Sheets

METHODS AND SYSTEMS TO THERMALLY PROTECT FUEL NOZZLES IN COMBUSTION SYSTEMS

STATEMENT REGARDING FEDERALLY SPONSORED RESEARCH & DEVELOPMENT

This invention was made with Government support under Contract No. DE-FC26-05NT42643, awarded by the Department of Energy. The Government has certain rights in this invention.

BACKGROUND OF THE INVENTION

The embodiments described herein relate generally to gas turbine combustion systems and, more particularly, to fuel and air premixers that facilitate reducing damage during an off-design flame holding event.

At least some known gas turbine engines ignite a fuel-air mixture in a combustor to generate a combustion gas stream that is channeled to a turbine via a hot gas path. Compressed air is delivered to the combustor from a compressor. Known combustor assemblies include fuel nozzles that facilitate fuel and air delivery to a combustion region of the combustor. The turbine converts the thermal energy of the combustion gas stream to mechanical energy used to rotate a turbine shaft. The output of the turbine may be used to power a machine, for example, an electric generator or a pump.

Emissions produced by gas turbines burning conventional hydrocarbon fuels may include oxides of nitrogen, carbon monoxide, and unburned hydrocarbons. It is well known in the art that the oxidation of molecular nitrogen (NOx) in air breathing engines is dependent upon the hot gas temperatures created in the combustion system reaction zone. One method of reducing NOx emissions is to maintain the temperature of the reaction zone of a heat engine combustor at or below the level at which thermal NOx is formed by premixing fuel and air to a lean mixture prior to the mixture being ignited. Often such a process is done in a Dry Low NOx (DLN) combustion system. In such systems, the thermal mass of excess air present in the reaction zone of the combustor absorbs heat to reduce the temperature rise of the products of combustion to a level where the generation of thermal NOx is reduced.

During the combustion of gaseous or liquid fuels, known lean-premixed combustors may experience flame holding or flashback in which the flame that is intended to be confined within the combustion liner travels upstream towards the injection locations of fuel and air into the premixing section. Such flame holding/flashback events may result in degradation of emissions performance and/or overheating and damage to the premixing section, due to the extremely large thermal load. At least some known gas turbine combustion systems include premixing injectors that premix fuel and compressed airflow in an attempt to channel uniform lean fuel-air premixtures to a combustion liner. Typically, a bulk burner tube velocity exists, above which a flame in the premixer will be pushed out to a primary burning zone.

As more reactive fuels, such as synthetic gas ("syngas"), syngas with pre-combustion carbon-capture (which results in a high-hydrogen fuel), and/or natural gas with elevated percentages of higher-hydrocarbons are used, current DLN combustion systems may have difficulty in maintaining flame holding during engine operation. In ideal operating conditions, a flame inside the premixer does not remain in the premixer, but rather is displaced downstream into the normal combustion zone. Since the design point of state-of-the-art combustion systems may reach bulk flame temperatures of 3000° F., flame holding/flashback events may cause extensive damage to the premixing nozzle section in a very short period of time.

BRIEF DESCRIPTION OF THE INVENTION

In one aspect, a method of assembling a gas turbine engine is provided. The method includes coupling a combustor in flow communication with a compressor such that the combustor receives at least some of the air discharged by the compressor. A fuel nozzle assembly is coupled to the combustor and includes at least one fuel nozzle that includes a plurality of interior surfaces, wherein a thermal barrier coating is applied across at least one of the plurality of interior surfaces to facilitate shielding the interior surfaces from combustion gases.

In another aspect, a fuel nozzle for use in a gas turbine engine is provided. The fuel nozzle includes a plurality of interior surfaces, and a thermal barrier coating applied across at least one of the plurality of fuel nozzle interior surfaces. The thermal barrier coating is configured to shield the fuel nozzle interior surfaces from combustion gases.

In yet another aspect, a gas turbine system is provided. The gas turbine system includes a compressor, a combustor, and a thermal barrier coating. The combustor is in flow communication with the compressor to receive at least some of the air discharged by said compressor. The combustor includes at least one fuel nozzle that includes a plurality of interior surfaces. The thermal barrier coating is applied across at least one of the plurality of fuel nozzle interior surfaces. The thermal barrier coating is configured to shield the fuel nozzle interior surfaces from combustion gases.

The present invention provides a DLN combustion system that is substantially tolerant to flame holding, thereby allowing sufficient time to detect a flame in the premixer and correct the condition. Moreover, as described here, the application of a thermal barrier coating to the premixer facilitates reducing an amount of cooling fluid required in the premixer, thus resulting in enhanced cost savings and reduced maintenance costs. This advantageously enables combustion systems to operate more efficiently with syngas, high-hydrogen, and other reactive fuels with a significantly reduced risk of costly hardware damage and forced outages.

DETAILED DESCRIPTION OF THE INVENTION

The exemplary methods and systems described herein overcome the disadvantages of known Dry Low NOx (DLN) combustion systems by providing a fuel nozzle that includes an advanced cooling system that facilitates enhanced flame holding/flashback tolerance. More specifically, the embodiment herein facilitates preventing fuel nozzle damage during flame holding/flashback events by providing a cooling flow that reduces the fuel nozzle temperatures and thus increases the time to detect events in the premixer and to remedy any adverse conditions detected. In one embodiment, a fuel nozzle includes a cooling system that provides a combination of backside convection cooling, impingement cooling, and film cooling to facilitate reducing the temperature of the fuel nozzle during flame holding. As used herein, the term "coolant" and "cooling fluid" refer to nitrogen, air, fuel, or some combination thereof, and/or any other fluid that enables the fuel nozzle to function as described herein.

In the exemplary embodiment, a thermal barrier coating (TBC) is applied to the fuel nozzle to form a barrier that shields the fuel nozzle and facilitates reducing the cooling flow needed and or lowering the temperature of the fuel nozzle premixer components. As described in more detail below, the thickness of TBC applied can be variably selected to achieve a desired level of thermal resistance, i.e., required temperature drop across a TBC system. It should be appreciated that the terms "axial" and "axially" as used throughout this application refer to directions and orientations extending substantially parallel to a center longitudinal axis of a center body of a fuel nozzle. It should also be appreciated that the terms "radial" and "radially" are used throughout this application to refer to directions and orientations extending substantially perpendicular to a center longitudinal axis of the center body. It should also be appreciated that the terms "upstream" and "downstream" are used throughout this application to refer to directions and orientations located in an overall axial fuel flow direction with respect to the center longitudinal axis of the center body.

Figure 1:
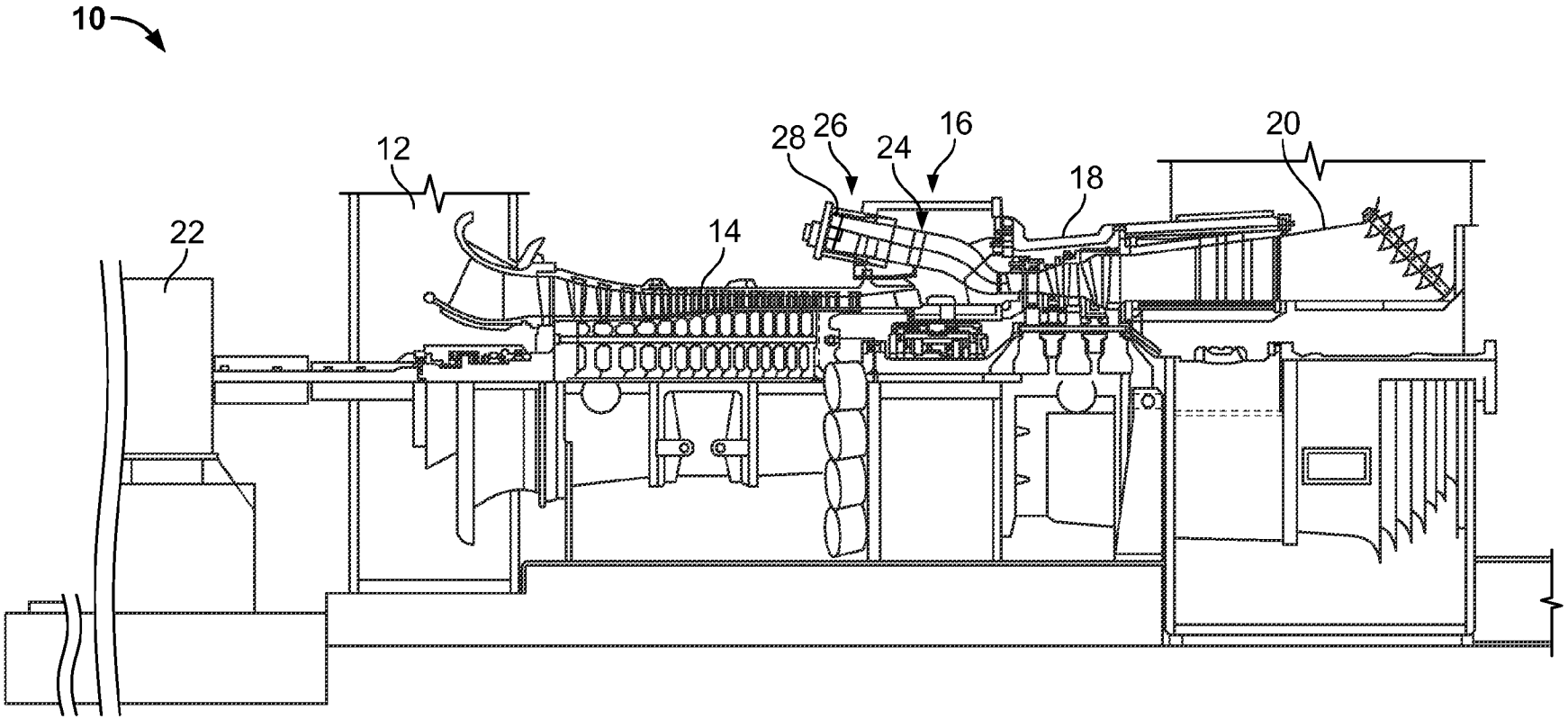
FIG. 1 is a cross-sectional view of an exemplary gas turbine system.

FIG. 1 is a cross-sectional view of an exemplary gas turbine system 10 that includes an intake section 12, a compressor section 14 downstream from the intake section 12, a combustor section 16 coupled downstream from the intake section 12, a turbine section 18 coupled downstream from the combustor section 16, and an exhaust section 20. Combustor section 16 includes a plurality of combustors 24. Gas turbine system 10 includes a fuel nozzle assembly 26. Fuel nozzle assembly 26 includes a plurality of fuel nozzles 28. Combustor section 16 is coupled to compressor section 14 such that the combustor 24 is in flow communication with the compressor 14. Fuel nozzle assembly 26 is coupled to combustor 24. Turbine section 18 is rotatably coupled to compressor section 14 and to a load 22 such as, but not limited to, an electrical generator and a mechanical drive application.

During operation, intake section 12 channels air towards compressor section 14. Compressor section 14 compresses the inlet air to higher pressures and temperatures and discharges the compressed air towards combustor section 16 wherein it is mixed with fuel and ignited to generate combustion gases that flow to turbine section 18, which drives compressor section 14 and/or load 22. Specifically, the compressed air is supplied to fuel nozzle assembly 26. Fuel is channeled to a fuel nozzle 28 wherein the fuel is mixed with the air and ignited downstream of fuel nozzle 28 in combustor section 16. Combustion gases are generated and channeled to turbine section 18 wherein gas stream thermal energy is converted to mechanical rotational energy. Exhaust gases exit turbine section 18 and flow through exhaust section 20 to ambient atmosphere.

Figure 2:
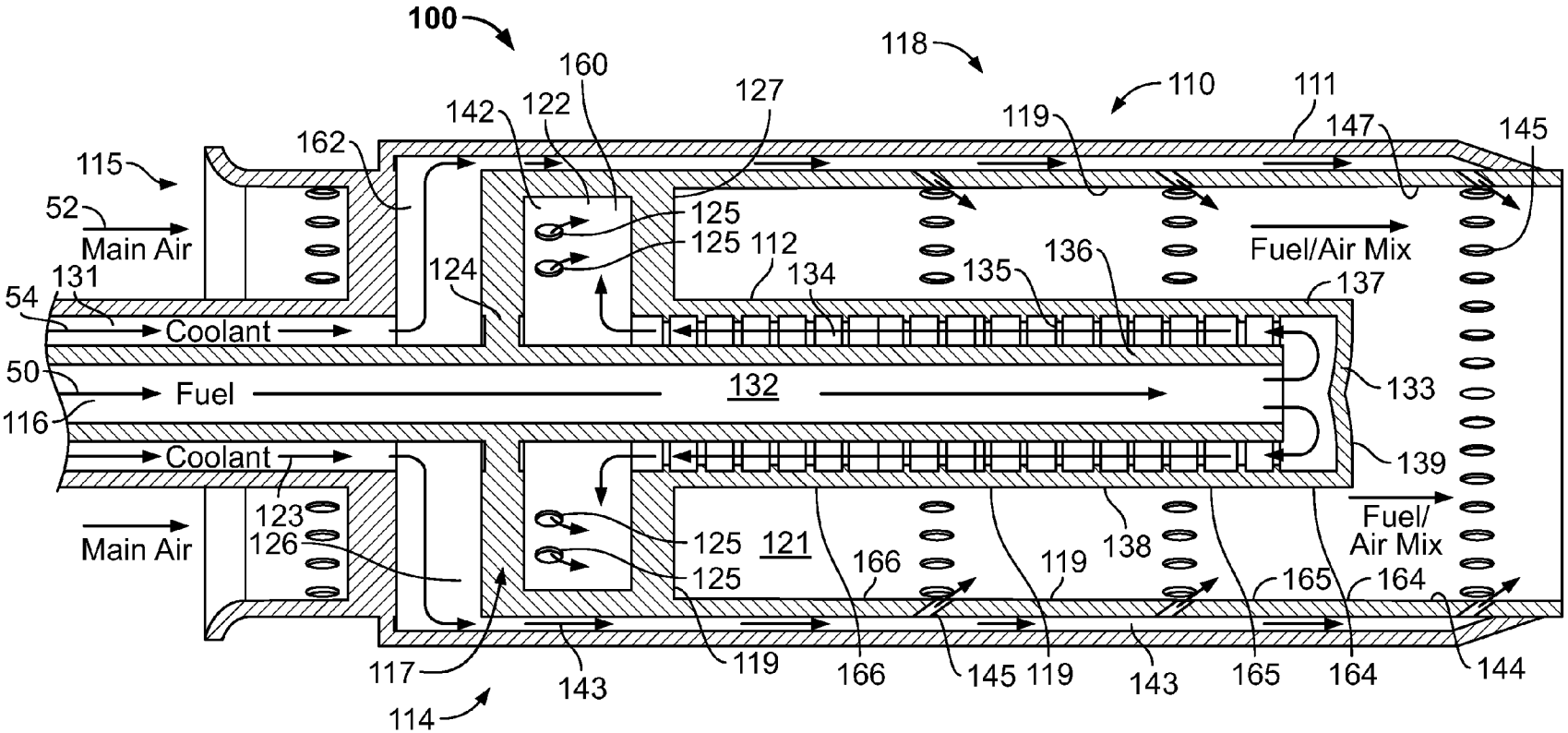
FIG. 2 is an exemplary fuel nozzle that may be used with the gas turbine engine shown in FIG. 1.
Figure 3:
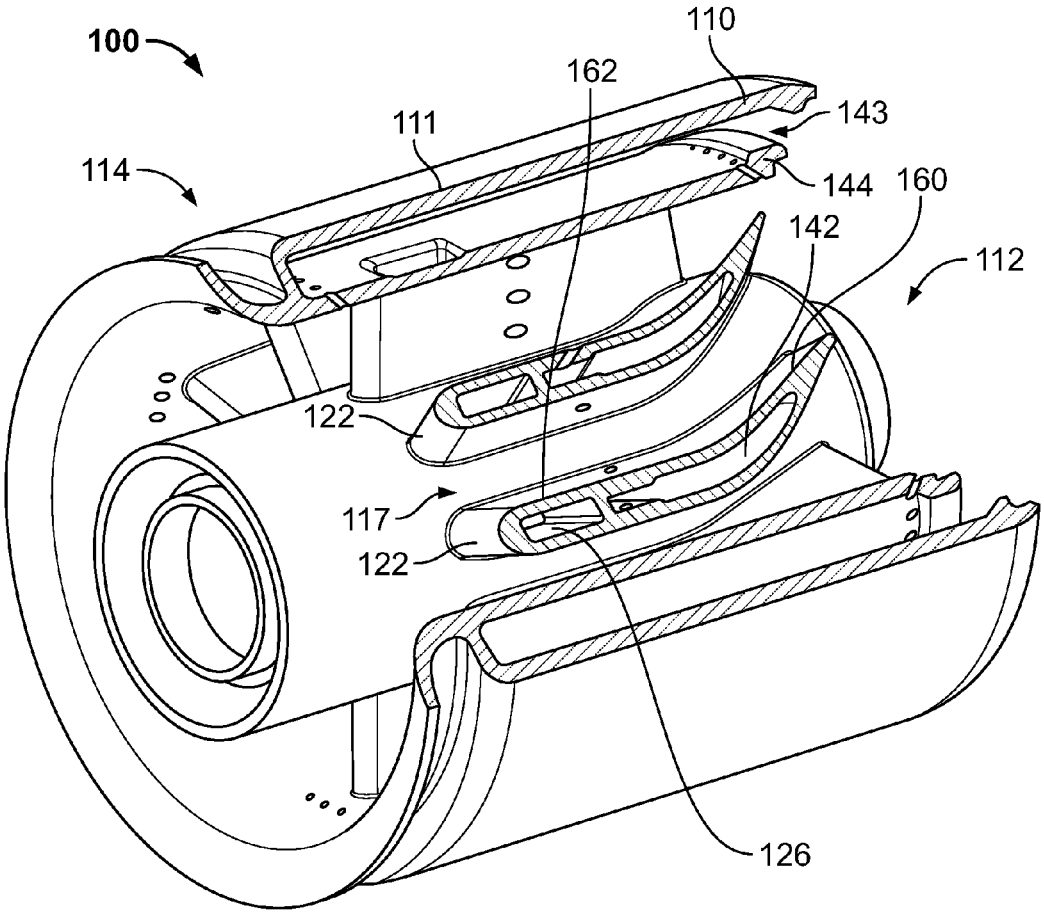
FIG. 3 is an enlarged cross-sectional view of an exemplary fuel nozzle that may be used with the gas turbine engine shown in FIG. 1.

FIG. 2 is an exemplary fuel nozzle 100 that may be used with the gas turbine engine 10. FIG. 3 is an enlarged cross-sectional view of exemplary fuel nozzle 100. In the exemplary embodiment, fuel nozzle 100 includes a burner tube 110, a nozzle center body 112, a fuel/air premixer 114, and a thermal barrier coating 118. Nozzle center body 112 extends through burner tube 110 such that premixer passage 121 is defined between center body 112 and burner tube 110. In the exemplary embodiment, fuel nozzle 100 includes a plurality of inner surfaces 119.

Burner tube 110 includes an annular cavity 143 that is defined between an outer peripheral wall 111 and an interior burner wall 144. A plurality of orifices 145 are defined within, and extend through interior burner wall 144 to couple annular cavity 143 in flow communication with premixer passage 121. Interior burner wall 144 includes an outer surface 147. In an alternative embodiment, burner tube 110 does not include orifices 145.

Center body 112 includes a radially outer circumferential wall 137, a radially inner circumferential wall 136, a fuel passage 132, a reverse flow passage 134, an end wall 133, and an intermediate wall 124. Outer wall 137 includes an exterior surface 138. End wall 133 includes an outer surface 139. Fuel passage 132 is defined by inner wall 136 and extends from fuel/air premixer 114 towards end wall 133. Intermediate wall 124 extends between interior burner wall 144 and inner wall 136 and is positioned between coolant inlet 131 and end wall 133. Reverse flow passage 134 is defined within center body 112 and extends substantially axially from end wall 133 to intermediate wall 124. Reverse flow passage 134 is substantially concentrically aligned with fuel passage 132 and is separated from fuel passage 132 by inner circumferential wall 136 that is defined within center body 112. A plurality of annular ribs 135 are positioned within reverse flow passage 134 such that ribs 135 are spaced along reverse flow passage 134 to facilitate optimizing and enhancing heat transfer across outer circumferential wall 137 from premixing passage 121 to reverse flow passage 134. Ribs 135 may have any shape that facilitates such heat transfer, including, but not limited to, discrete arcuate annular rings that extend circumferentially from wall 136, and/or independent nubs that extend from wall 136.

Fuel/air premixer 114 includes an air inlet 115, a fuel inlet 116, coolant inlet 131, a coolant passage 123, swirl vanes 122, and vane passages 117 that are defined between swirl vanes 122. Swirl vanes 122 include an outer surface 127. Coolant passage 123 is defined within fuel/air premixer 114 and extends from coolant inlet 131 to intermediate wall 124. Chambers 142 are defined within a trailing portion 160 of vanes 122 such that chambers 142 are coupled in flow communication with reverse flow passage 134. A plurality of injection ports 125 are defined within and extend through trailing portions 160 of vanes 122 to couple chambers 142 and reverse flow passage 134 in flow communication with premixing passage 121. Chambers 126 are defined within a leading portion 162 of vanes 122 such that chambers 126 are coupled in flow communication with coolant passage 123.

Burner tube 110 is coupled to fuel/air premixer 114 such that chambers 126 are in flow communication with annular cavity 143. Center body 112 is coupled to fuel/air premixer 114 such that chambers 142 are positioned in flow communication with reverse flow passage 134 and premixing passage 121, and fuel passage 132 extends from fuel inlet 116 to end wall 133.

Figure 4:
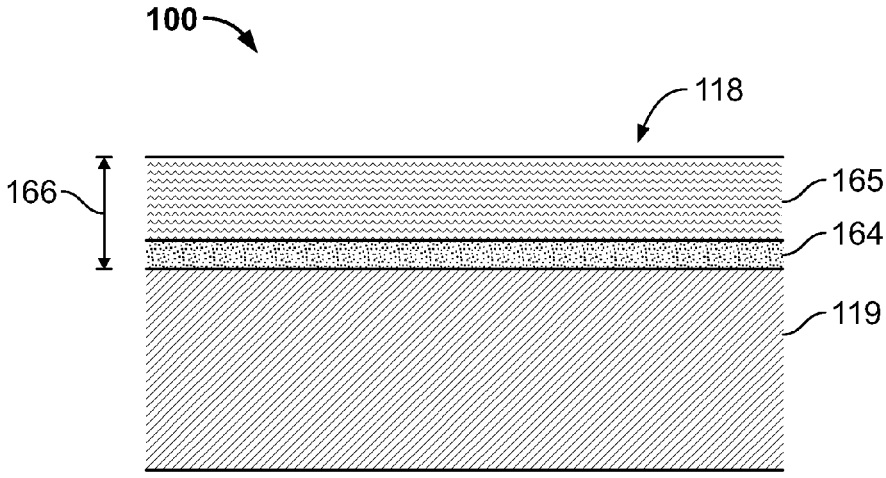
FIG. 4 is a schematic view of an exemplary thermal barrier coating that may be used with an exemplary fuel nozzle.

FIG. 4 is a schematic view of exemplary thermal barrier coating 118 that may be used with fuel nozzle 100. In the exemplary embodiment, thermal barrier coating 118 is applied to a plurality of inner surfaces 119 of fuel nozzle 100. Thermal barrier coating 118 is applied using a plasma spray method. In an alternative embodiment, thermal barrier coating 118 is applied using an electron beam physical vapor deposition (EB-PVD), spraying a slurry solution of thermal barrier coating 118 onto fuel nozzle 100, and/or dipping fuel nozzle 100 into a slurry solution of thermal barrier coating 118. Thermal barrier coating 118 includes a metallic bond coating 164 that is initially applied across at least portions of inner surfaces 119 and a ceramic coating 165 that is then applied across at least portions of metallic bond coating 164. In the exemplary embodiment, thermal barrier coating 118 is applied with a thickness 166 that ranges from about four thousandths of an inch (0.004 inches) to about one hundred thousandths of an inch (0.100). In the exemplary embodiment, thermal barrier coating has a thickness 166 of between about 20 thousandths of an inch (0.020 inches) to 30 thousandths of an inch (0.030 inches). However, it should be understood that thickness 166 of thermal barrier coating 118 can be variably selected to ensure a desired level of thermal resistance is achieved that enables fuel nozzle 100 to function as described herein.

During operation, fuel 50 enters nozzle center body 112 through fuel inlet 116 into fuel passage 132. Fuel 50 is channeled through center body 112 and impinges upon end wall 133, whereupon the flow of fuel 50 is reversed and fuel is channeled into reverse flow passage 134. As fuel enters reverse flow passage 134, the fuel is channeled over ribs 135 and towards intermediate wall 124, wherein the fuel 50 impinges upon wall 124 and is then redirected into chambers 142. Fuel 50 is expelled from chambers 142 through injection ports 125 and into vane passages 117 and premixing passage 121. Air 52 is directed into vane passages 117 and through air inlet 115. As air 52 passes past vanes 122, the air is mixed with fuel 50 discharged from injection ports 125 within premixing passage 121. To facilitate complete combustion, premixing passage 121 is sized to ensure the fuel/air mixture is substantially fully mixed prior to the mixture being discharged into the combustor reaction zone (not shown). In the exemplary embodiment, fuel 50 facilitates cooling end wall 133 as it flows through passage 132 to impinge against end wall 133. In addition, fuel 50 facilitates backside convection cooling of premixing passage 121 as it flows through reverse flow passage 134. Thus, the outer circumferential wall 137 of center body 112 is cooled by convective cooling as fuel 50 flows through fuel passage 132 and reverse flow passage 134.

Coolant 54 is channeled into center body 112 through coolant inlet 131 and into coolant passage 123. Coolant 54 impinges upon intermediate wall 124 and is directed into chambers 126. Coolant 54 is channeled through chambers 126 and into an annular cavity 143 prior to being discharged through orifice 145. In the exemplary embodiment, coolant 54 facilitates cooling burner outer peripheral wall 111 as it flows through annular cavity 143. Moreover, coolant 54 also provides film cooling of interior burner wall 144 as it discharges through orifices 145. In addition, backside convection cooling on outer peripheral wall 111 is provided as coolant 54 flows through annular cavity 143.

During operation, thermal barrier coating 118 facilitates shielding inner surfaces 119 of fuel nozzle 100 from the combustion gases generated within premixing passage 121 during an off-design flame holding event. In one embodiment, at least a 100° F. reduction in metal temperature was achieved with the use of a thermal barrier coating 118. As such, in such an embodiment, 25% less cooling flow can be used to protect fuel nozzle 100 from thermal damage during flame hold/flashback events with the same operating conditions.

Figure 5:
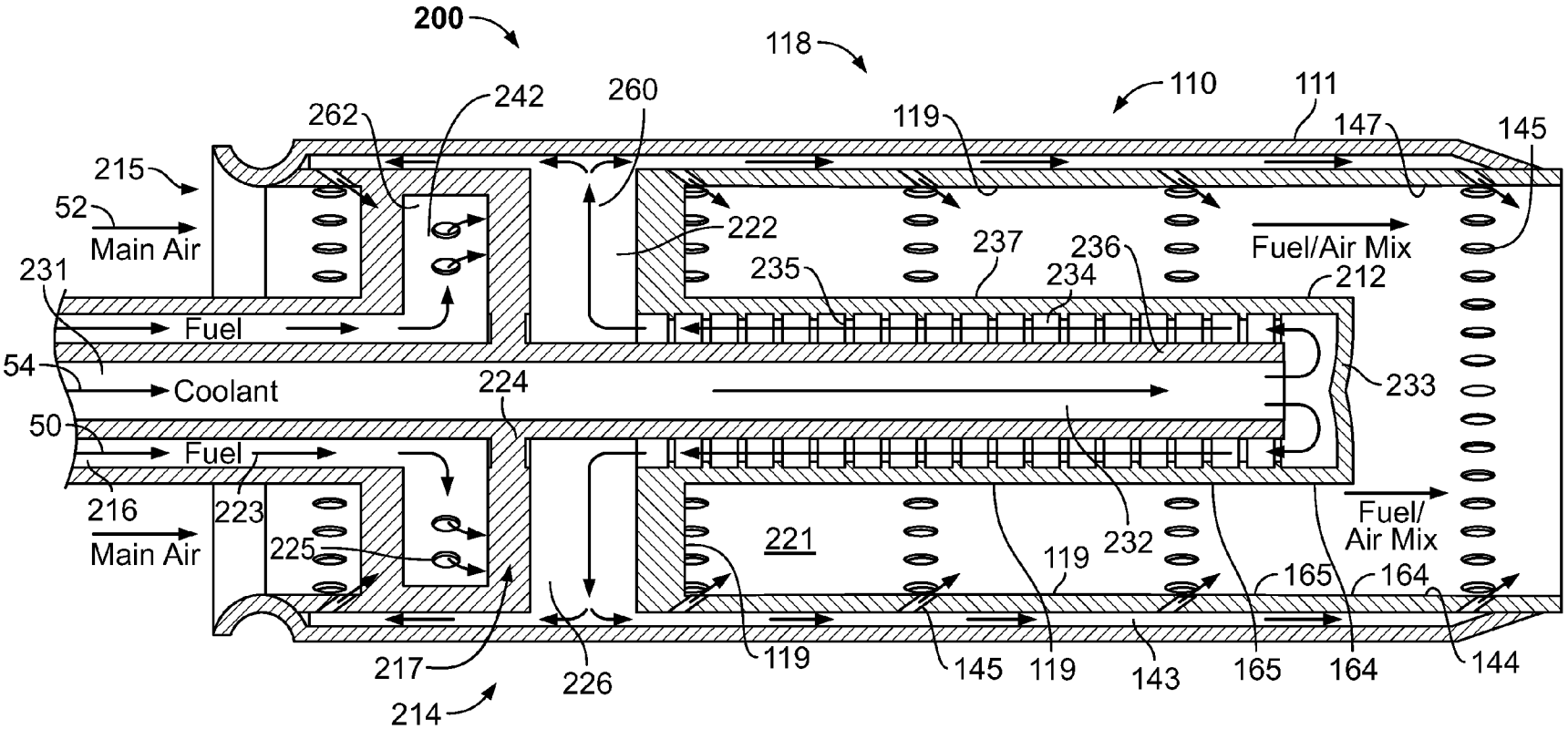
FIG. 5 is an alternative embodiment of a fuel nozzle that may be used with the gas turbine engine shown in FIG. 1.

FIG. 5 is an alternative embodiment of a fuel nozzle 200 that may be used with the gas turbine 10. Components referred in FIG. 3 that are identical to those shown in FIG. 2 are identified with the same reference numbers in FIG. 3. Accordingly, fuel nozzle 200 includes burner tube 110, a nozzle center body 212, a fuel/air premixer 214, and a thermal barrier coating 118. Nozzle center body 212 extends through burner tube 110 such that premixer passage 221 is defined between center body 212 and burner tube 110. Fuel nozzle 200 includes a plurality of inner surfaces 119.

In an alternative embodiment, center body 212 includes a radially outer wall 237, a radially inner wall 236, a coolant passage 232, a reverse flow passage 234, an end wall 233, and an intermediate wall 224. Coolant passage 232 extends from fuel/air premixer 214 towards end wall 233, and intermediate wall 224 extends between interior burner wall 144 and inner wall 236 and is positioned between fuel inlet 216 and end wall 233. Reverse flow passage 234 is defined within center body 212 and extends from end wall 233 to intermediate wall 224. Moreover, reverse flow passage 234 is aligned substantially concentrically with coolant passage 232 and is separated from cooling passage 232 by inner wall 236 that extends within center body 212. A plurality of annular ribs 235 are positioned within reverse flow passage 234, such that ribs 235 are spaced along reverse flow passage 234 to facilitate optimizing and enhancing heat transfer across outer circumferential wall 237 from premixing passage 221 to reverse flow passage 234.

Fuel/air premixer 214 includes an air inlet 215, fuel inlet 216, a coolant inlet 231, a fuel passage 223, swirl vanes 222, and vane passages 217 that are defined between swirl vanes 222. Fuel passage 223 is defined within fuel/air premixer 214 and extends from fuel inlet 216 to intermediate wall 224. Chambers 242 are defined within a leading portion 262 of vanes 222 and are in flow communication with fuel passage 223. A plurality of injection ports 225 are defined within and extend through leading portion 262 of vanes 222 to couple fuel passage 223 in flow communication with premixing passage 221. Chambers 226 are defined within a trailing portion 260 of vanes 222 such that chambers 226 are coupled in flow communication with reverse flow passage 234.

Burner tube 110 is coupled to fuel/air premixer 214 such that chambers 226 are in flow communication with annular cavity 143. Center body 212 is coupled to fuel/air premixer 214 such that chambers 226 are positioned in flow communication with annular cavity 143 and reverse flow passage 234, and coolant passage 232 extends from coolant inlet 231 to end wall 233. Thermal barrier coating 118 is applied to inner surfaces 119 of fuel nozzle 200.

In the alternative embodiment, during operation, fuel 50 enters nozzle center body 212 through fuel inlet 216 into fuel passage 223. Fuel 50 impinges upon intermediate wall 224, whereupon the flow of fuel 50 is channeled into chamber 242 and discharged from chambers 242 through injection ports 225 and into vane passages 217. Coolant 54 enters center body 212 through coolant inlet 231 and into coolant passage 232. Coolant 54 is channeled through center body 212 and impinges upon end wall 233, whereupon the flow of coolant 54 is reversed and coolant 54 is channeled into reverse flow passage 234. As coolant 54 enters reverse flow passage 234, coolant 54 is channeled over ribs 235 and towards intermediate wall 224, wherein coolant 54 impinges upon intermediate wall 224 and is redirected into chambers 226. Coolant 54 is channeled through chambers 226 and into annular cavity 143 prior to being discharged through the plurality of orifices 145.

In the alternative embodiment, coolant 54 facilitates cooling burner outer peripheral wall 111 as it flows through annular cavity 143 and provides film cooling across interior burner wall 144 as coolant 54 is discharged through orifice 145. In addition, backside convection cooling on outer peripheral wall 111 is provided as coolant 54 flows through annular cavity 143. Coolant 54 also facilitates cooling end wall 233 as it flows through coolant passage 232 to impinge against end wall 233. In addition, coolant 54 facilitates backside convection cooling of outer wall 237 as it flows through reverse flow passage 234. Thermal barrier coating 118 facilitates shielding inner surfaces 165 of fuel nozzle 200 from the combustion gases generated within fuel nozzle 200 during an off-design flame holding event. As such, in such an alternative embodiment, the amount of coolant flow needed to facilitate reducing damage to fuel nozzle 200 during flame hold/flashback events is reduced, with the same operating conditions.

The above-described methods and systems facilitate improving the operation of Dry Low NOx (DLN) combustion systems by providing a fuel nozzle that has enhanced flame holding/flashback characteristics. As such, the embodiments described herein facilitate the use of more reactive fuels, such as synthetic gas ("syngas") and natural gas with elevated percentages of higher-hydrocarbons in DLN combustion systems in a cost effective manner in, for example, gas turbine applications. The above-described systems also provide a method of reducing damage during flame holding/flashback events by using a fuel nozzle with a cooling system that includes a combination of backside convection cooling, impingement cooling, and film cooling and a thermal barrier coating. As such, the performance life of the Dry Low NOx combustion systems can be extended because of the reduction in damage due to flame holding/flashback events that may occur over the operational life of the DLN combustion systems.

Exemplary embodiments of methods and systems to thermally protect fuel nozzles in combustion systems are described above in detail. The methods and systems are not limited to the specific embodiments described herein, but rather, components of systems and/or steps of the methods may be utilized independently and separately from other components and/or steps described herein. For example, the methods may also be used in combination with other fuel combustion systems and methods, and are not limited to practice with only the DLN combustion systems and methods as described herein. Rather, the exemplary embodiment can be implemented and utilized in connection with many other fuel combustion applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of assembling a gas turbine engine, said method comprising:

coupling a combustor in flow communication with a compressor such that the combustor receives at least some of the air discharged by the compressor; and coupling a fuel nozzle assembly to the combustor, wherein the fuel nozzle assembly includes at least one fuel nozzle that includes:

a burner tube including an outer peripheral wall and an inner peripheral wall adjacent to the outer wall such that an annular peripheral cooling passage is defined therebetween;

a nozzle center body positioned within the outer wall such that the inner peripheral wall and the nozzle center body define a premixing passage therebetween that is in flow communication with the peripheral cooling passage through at least one outlet orifice;

a nozzle cooling passage defined within the nozzle center body is in fluid communication with a source of air or inert gas for channeling therethrough;

wherein the air or inert gas is conveyed from said nozzle cooling passage to said peripheral cooling passage;

a fuel/air premixer including an outer surface and surrounding a proximal end portion of the nozzle center body; and a thermal barrier coating applied across at least a portion of the fuel/air premixer outer surface, the burner tube, and the nozzle center body to facilitate shielding the fuel/air premixer outer surface, the burner tube, and the nozzle center body from combustion gases.

2. A method in accordance with claim 1 further comprising applying a thermal barrier coating across at least a portion of the burner tube inner peripheral wall.

3. A method in accordance with claim 1 wherein the center body includes an outer surface, said method further comprising applying the thermal barrier coating across at least a portion of the center body outer surface.

4. A method in accordance with claim 1, wherein coupling a fuel nozzle assembly to the combustor further comprises:

applying a metallic bond coating across at least a portion of the fuel/air premixer outer surface, the burner tube, and the nozzle center body; and applying a ceramic thermal coating across at least a portion of the metallic bond coating.

5. A fuel nozzle for use in a gas turbine engine, said fuel nozzle comprising:

a burner tube comprising an outer peripheral wall and an inner peripheral wall adjacent to the outer wall such that an annular peripheral cooling passage is defined therebetween;

a nozzle center body positioned within the outer wall such that the inner peripheral wall and the nozzle center body define a premixing passage therebetween that is in flow communication with the peripheral cooling passage through at least one outlet orifice;

a nozzle cooling passage defined within the nozzle center body is in fluid communication with a source of air or inert gas for channeling therethrough;

wherein the air or inert gas is conveyed from said nozzle cooling passage to said peripheral cooling passage;

a fuel/air premixer comprising an outer surface and surrounding a proximal end portion of said nozzle center body; and a thermal barrier coating applied across at least a portion of said fuel/air premixer outer surface, said burner tube, and said nozzle center body, said thermal barrier coating configured to shield at least a portion of said fuel/air premixer outer surface, said burner tube, and said nozzle center body from combustion gases.

6. A fuel nozzle in accordance with claim 5, wherein said thermal barrier coating is applied across at least a portion of said burner tube inner peripheral wall.

7. A fuel nozzle in accordance with claim 5, wherein said center body comprises an outer surface, said thermal barrier coating applied across at least a portion of said center body outer surface.

8. A fuel nozzle in accordance with claim 5, wherein said thermal barrier coating comprises:

a metallic bond coating applied across at least a portion of said fuel/air premixer outer surface, said burner tube, and said nozzle center body; and a ceramic coating applied across at least a portion of said metallic bond coating.

9. A fuel nozzle in accordance with claim 5, wherein said thermal barrier coating has a thickness of between about 0.004 inches to about 0.100 inches.

10. A fuel nozzle in accordance with claim 5, wherein:

said burner tube is coupled to said fuel/air premixer; and said nozzle center body is coupled to said fuel/air premixer such that said nozzle center body extends through said burner tube.

11. A fuel nozzle in accordance with claim 5, wherein said fuel/air premixer further comprises a plurality of swirl vanes that define internal cooling passages therein.

12. A fuel nozzle in accordance with claim 5, wherein said center body comprises:

an inner wall, an outer wall;

a fuel passage defined within said inner wall; and a reverse flow passage defined between said inner wall and said outer wall.

13. A gas turbine system comprising:

a compressor;

a combustor in flow communication with said compressor to receive at least some of the air discharged by said compressor, said combustor comprising at least one fuel nozzle comprising a plurality of interior surfaces and a fuel/air premixer that includes an outer surface;

a burner tube including an outer peripheral wall and an inner peripheral wall adjacent to the outer wall such that an annular peripheral cooling passage is defined therebetween;

a nozzle center body positioned within the outer wall such that the inner peripheral wall and the nozzle center body define a premixing passage therebetween that is in flow communication with the peripheral cooling passage through at least one outlet orifice;

a nozzle cooling passage defined within the nozzle center body is in fluid communication with a source of air or inert gas for channeling therethrough;

wherein the air or inert gas is conveyed from said nozzle cooling passage to said peripheral cooling passage;

a fuel/air premixer including an outer surface and surrounding a proximal end portion of the nozzle center body; and a thermal barrier coating applied across at least a portion of said fuel/air premixer outer surface, said burner tube, and said nozzle center body, said thermal barrier coating configured to shield at least a portion of said fuel/air premixer outer surface, said burner tube, and said nozzle center body from combustion gases.

14. A gas turbine system in accordance with claim 13, wherein said thermal barrier coating is applied across at least a portion of said burner tube inner peripheral wall.

15. A gas turbine system in accordance with claim 13, wherein said center body comprises an outer surface, said thermal barrier coating applied across at least a portion of said center body outer surface.

16. A gas turbine system in accordance with claim 13, wherein said thermal barrier coating comprises:

a metallic bond coating applied across at least a portion of said fuel/air premixer outer surface, said burner tube, and said nozzle center body; and a ceramic coating applied across at least a portion of said metallic bond coating.

17. A gas turbine system in accordance with claim 13, wherein said thermal barrier coating has a thickness of between about 0.004 inches to about 0.100 inches.

* * * * *